US011168516B2

(12) United States Patent
van Leeuwen

(10) Patent No.: US 11,168,516 B2
(45) Date of Patent: Nov. 9, 2021

(54) PROTECTION DEVICE HAVING TWO GASKETS OF DIFFERENT HEIGHTS

(71) Applicant: Arnd Büdenbender, Netphen-Deuz (DE)

(72) Inventor: Ritske Johannes van Leeuwen, Koedijk (NL)

(73) Assignee: Arnd Budenbender, Netphen-Deuz (DE)

( * ) Notice: Subject to any disclaimer, the term of this patent is extended or adjusted under 35 U.S.C. 154(b) by 183 days.

(21) Appl. No.: 16/571,740

(22) Filed: Sep. 16, 2019

(65) Prior Publication Data

US 2020/0087979 A1 Mar. 19, 2020

(30) Foreign Application Priority Data

Sep. 17, 2018 (DE) ..... 10 2018 122 722.1

(51) Int. Cl.
*E06B 1/04* (2006.01)
*E06B 7/23* (2006.01)

(52) U.S. Cl.
CPC ..... *E06B 7/23* (2013.01)

(58) Field of Classification Search
CPC ..... E06B 7/23; E06B 9/522
USPC ..... 49/489.1, 484.1, 482.1, 505; 160/372, 160/374, 374.1, 381
See application file for complete search history.

(56) References Cited

U.S. PATENT DOCUMENTS 1,735,501 A * 11/1929 Hammill ..... E06B 9/522 160/374
2,357,819 A * 9/1944 Royden ..... G09F 7/00 160/351
2,624,405 A * 1/1953 Lynch ..... E06B 9/522 160/353
3,451,153 A * 6/1969 Dohanyos ..... E06B 3/92 40/741
4,445,563 A * 5/1984 Meyeroff ..... E06B 3/28 160/368.1
4,841,696 A * 6/1989 Miller ..... E06B 3/28 403/402
7,007,735 B1 * 3/2006 Lake ..... E06B 9/52 160/374.1
7,624,548 B2 * 12/2009 Hansen ..... E04G 21/24 52/202
7,874,090 B2 * 1/2011 Flagg ..... G09F 15/0068 40/605
8,966,839 B2 * 3/2015 Rebman ..... E06B 3/263 52/203
2018/0051510 A1 * 2/2018 Russo, Jr. ..... E06B 7/28

FOREIGN PATENT DOCUMENTS

DE 19835390 A1 9/1999
EP 3138990 A1 3/2017

*Primary Examiner* — Jerry E Redman
(74) *Attorney, Agent, or Firm* — Johnson, Marcou, Isaacs & Nix, LLC; Jennifer S. Stachiak, Esq.

(57) ABSTRACT

A protection device includes a tenter frame (1) having horizontal and vertical frame struts (2) and connectors, which connect the frame struts (2) to one another. Each of the frame struts (2) has at least one outer profile strip (3) and at least one inner profile strip (4) pushed in a telescoping manner into the outer profile strip(s) (3). The outer profile strip (3) forms an outer profile strip contour (5) extending along its longitudinal extension, and the inner profile strip (4) forms an inner profile strip contour (6) extending along its longitudinal extension.

5 Claims, 3 Drawing Sheets

PROTECTION DEVICE HAVING TWO GASKETS OF DIFFERENT HEIGHTS

CROSS-REFERENCE TO RELATED APPLICATIONS

The present application claims the priority date of Sep. 17, 2018, the filing date of the German patent application DE 10 2018 122 722.1.

BACKGROUND OF THE INVENTION

The present invention relates to a protection device, for example, a device for protection against insects to be used in a building opening or light well cover, comprising a tenter frame, wherein the tenter frame comprises horizontal and vertical frame struts and connectors which connect the frame struts to one another, wherein the frame struts each have at least one outer profile strip and at least one inner profile strip pushed into the outer profile strip(s) in a telescoping manner, wherein the at least one outer profile strip forms an outer profile strip contour extending along its longitudinal extension and the inner profile strip forms an inner profile strip contour extending along its longitudinal extension, and at least one gasket for each frame strut, wherein the at least one gasket is affixed to the outer profile strip contour and on the inner profile strip contour of the one frame strut.

A device for protection against insects is known from EP 3 138 990 A1. In this device for protection against insects, a gasket, also known as clamping strip, extends over the entire length of a frame strut. To ensure that this gasket is arranged in the same plane over the entire length of a frame strut and is thus able to seal the device for protection against insects in a uniform manner with respect to, for example, a window frame, provision is made of an adapter profile strip, on which the clamping strip is clipped in the area of an inner profile strip.

SUMMARY OF THE INVENTION

The problem addressed by the present invention is therefore that of remedying the disadvantages described with regard to the prior art and in particular, to specify a protection device in which a reliable seal is achieved, even without using an additional adapter profile strip.

The problem is solved by a protection device having the features of the independent claim. Advantageous further developments of the protection device are specified in the dependent claims and in the description, wherein individual features of the advantageous further developments can be combined with one another in any way in a technically meaningful manner.

Specifically, the problem is solved by a protection device having the features mentioned in the preceding, in which a first gasket is affixed to the outer profile strip contour and a second gasket is affixed to the inner profile strip contour, wherein the first gasket has a first height starting from the outer profile strip and the second gasket has a second height starting from the inner profile strip and the first height and the second height differ from one another.

In its fundamental concept, the present invention provides that for each frame strut, use is made of at least two different gaskets which differ from one another in terms of their height, wherein the height, in particular, is measured at a right angle to the plane formed by the tenter frame in the mounted state of the gaskets.

The first height of the first gasket and the second height of the second gasket are in particular dimensioned such that the ends of the first and second gaskets facing away from the profile strips end in a plane, which is parallel to the plane formed by the tenter frame. This ensures that the gaskets are pressed evenly at all places of the tenter frame, for example, against the frame surrounding a building opening. The gaskets are thus arranged such that, in the mounted state of the protection device, they abut against an element of the building, for example against a window frame.

The gaskets can be configured as lip seals, for example. However, the gaskets are embodied as brush gaskets in a preferred embodiment. The brush gaskets each comprise a fastening section, with which the brush gaskets can be affixed to the profile strips. The bristles, which are brought in abutment against the building opening, project out from this fastening section. In particular, the length of the bristles of the first brush gasket thus differs from the length of the bristles of the second brush gasket.

The inner profile strip contour and the outer profile strip contour are preferably embodied as channels, which extend along the respective profile strips and into which the gaskets are inserted and preferably snapped.

As an alternative, the profile strip contours can be embodied as projections which extend along the profile strips and to which the gaskets are affixed with, for example, a fastening section.

BRIEF DESCRIPTION OF THE DRAWINGS

The invention and the technical environment are described in an illustrative manner in the following, with reference to the figures.

DETAILED DESCRIPTION OF THE EXAMPLE EMBODIMENTS

Figure 1:
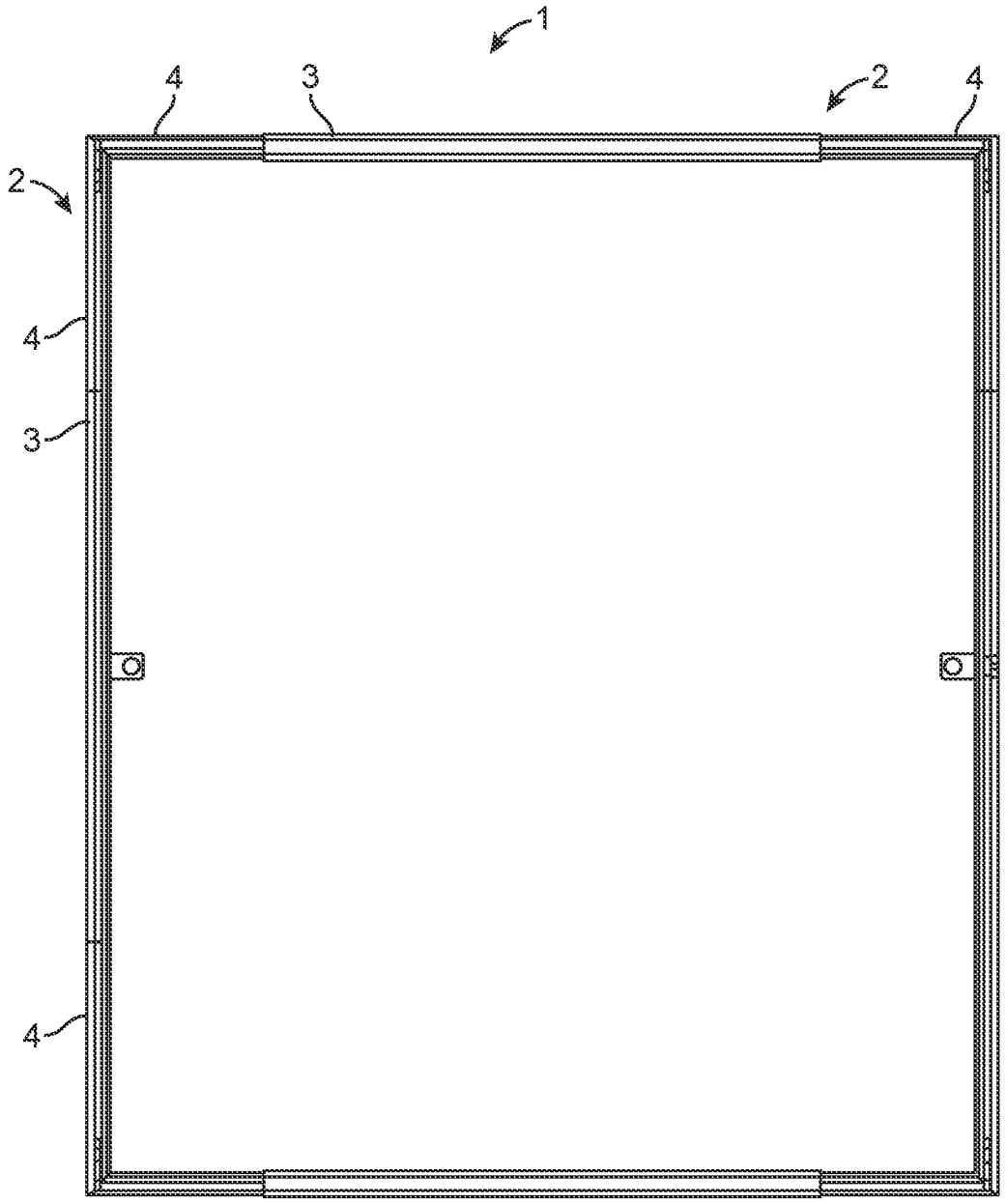
FIG. 1: shows a device for protection against insects for a window.
Figure 2:
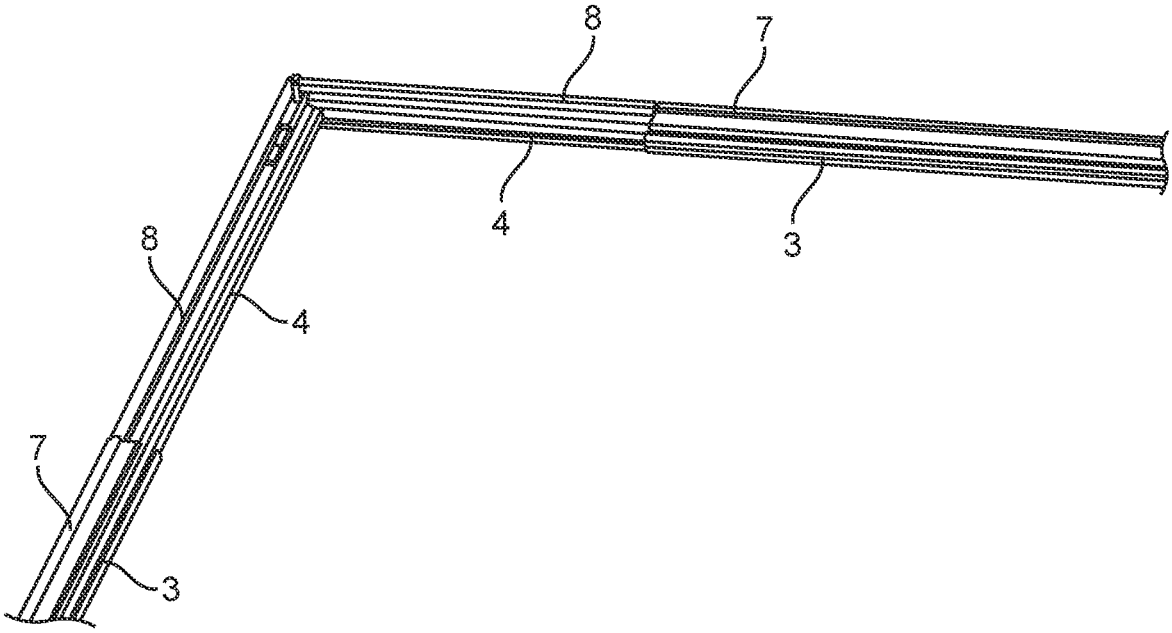
FIG. 2: shows a detailed view of the frame of the device for protection against insects, in the area of a corner.
Figure 3:
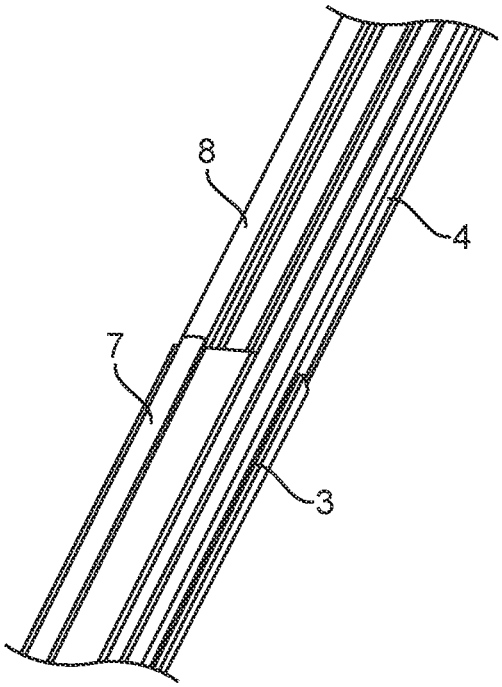
FIG. 3: shows a detailed view of a frame strut in the transition zone between an outer profile strip and an inner profile strip.

The device for protection against insects illustrated in FIG. 1 comprises a tenter frame 1 for tensioning an insect screen, which is not illustrated. The tenter frame 1 comprises four frame struts 2, which are each formed from two inner profile strips 4 and one outer profile strip 3, wherein the inner profile strips 4 engage in a telescoping manner in the respective outer profile strips 3. A back side of the tenter frame 1, which faces the window frame in a state of being mounted on the building, is illustrated in FIGS. 1 through 3.

Gaskets in the form of a first gasket 7 and a second gasket 8 are affixed to this back side of the tenter frame.

Figure 4:
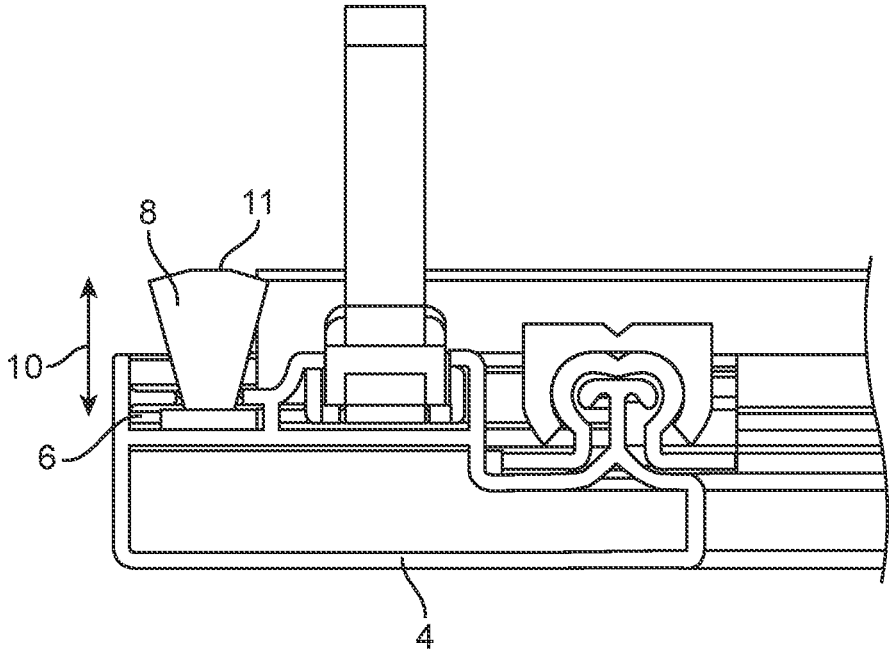
FIG. 4: shows a sectional view through a frame strut in the area of an inner profile strip.
Figure 5:
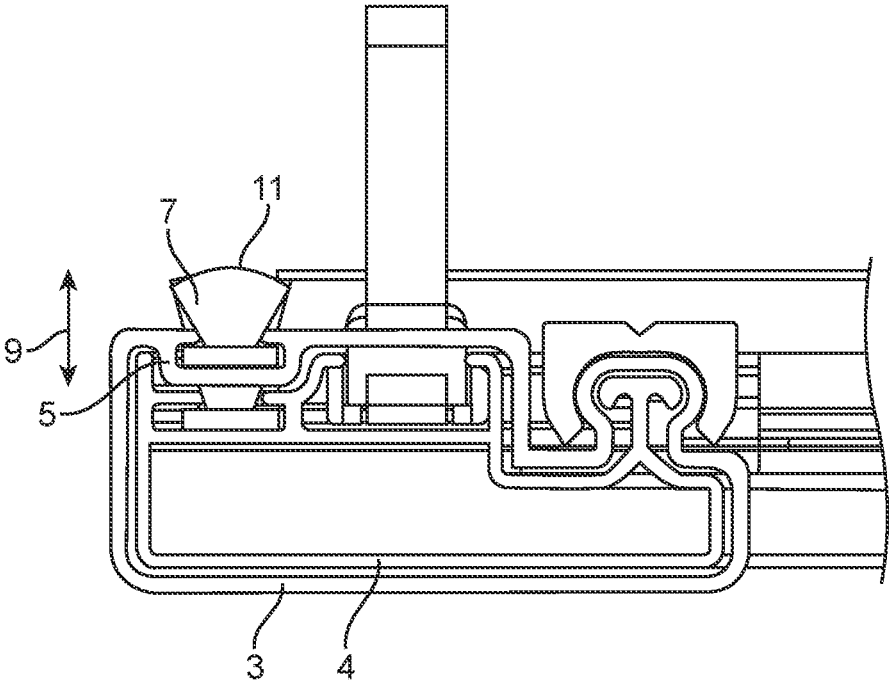
FIG. 5: shows a sectional view through a frame strut in the area of an outer profile strip.

As is particularly evident from FIGS. 4 and 5, the first gasket 7 is affixed to an outer profile strip contour 5 of the outer profile strip 3. The first gasket 7 has a first height 9.

The second gasket 8 is affixed to an inner profile strip contour 6 of the inner profile strip 4 and has a second height 10.

The first height 9 and the second height 10 of the gaskets 7, 8 configured as brush gaskets are chosen such that the brush gaskets each end with their free ends 11 in one plane. This ensures that the gaskets 7, 8 can be pressed evenly against a window frame over the entire periphery of the tenter frame 1.

The specification incorporates by reference the disclosure of DE 10 2018 122 722.1, filed Sep. 17, 2018.

The present invention is, of course, in no way restricted to the specific disclosure of the specification and drawings, but also encompasses any modifications within the scope of the appended claims.

What is claimed is:

1. A protection device comprising:

a tenter frame (1), the tenter frame comprising:

horizontal and vertical frame struts (2); and connectors to connect the frame struts (2) to one another, wherein the frame struts (2) each have:

at least one outer profile strip (3); and at least one inner profile strip (4) pushed in a telescoping manner into the at least one outer profile strip (3), wherein the at least one outer profile strip (3) forms an outer profile strip contour (5) extending along a longitudinal extension of the at least one out profile strip (3), and the at least one inner profile strip (4) forms an inner profile strip contour (6) extending along a longitudinal extension of the at least one inner profile strip (4); and at least one gasket for each frame strut (2), wherein the at least one gasket is affixed to the outer profile strip contour (5) and to the inner profile strip contour (6) of each frame strut (2), wherein a first gasket (7) is affixed to the outer profile strip contour (5) and a second gasket (8) is affixed to the inner profile strip contour (6), wherein the first gasket (7), starting from the outer profile strip (3), has a first height (9) and the second gasket (8), starting from the inner profile strip (4), has a second height (10), and wherein the first height (9) and the second height (10) differ from one another.

2. The protection device according to claim 1, wherein the first height (9) and the second height (10) are dimensioned such that respective ends (11) of the first gasket (7) and the second gasket (8) facing away from the profile strips (3, 4) end in one plane.

3. The protection device according to claim 1, wherein the first gasket (7) and second gasket (8) are brush gaskets.

4. The protection device according to claim 1, wherein the outer profile strip contour (5) and the inner profile strip contour (6) are channels extending along the profile strips (3, 4), wherein the gaskets (7, 8) are inserted into the channels.

5. The protection device according to claim 1, wherein the outer profile strip contour (5) and the inner profile strip contour (6) are projections extending along the profile strips (3, 4), wherein the gaskets (7, 8) are affixed to the projections.

* * * * *